US008354551B1

(12) United States Patent
Strecker et al.

(10) Patent No.: US 8,354,551 B1
(45) Date of Patent: Jan. 15, 2013

(54) PROCESS FOR PRODUCING ESTERIFIED PROPOXYLATED GLYCERIN

(75) Inventors: Leopold Strecker, Warren, NJ (US); Louie Flowers, Greenville, SC (US); Dana Overman, Roswell, GA (US); David Rowe, Indianapolis, IN (US)

(73) Assignee: Choco Finesse LLC, Lenexa, KS (US)

( * ) Notice: Subject to any disclaimer, the term of this patent is extended or adjusted under 35 U.S.C. 154(b) by 0 days.

(21) Appl. No.: 13/407,204

(22) Filed: Feb. 28, 2012

(51) Int. Cl.
*C11C 3/00* (2006.01)
*C11B 3/00* (2006.01)

(52) U.S. Cl. ..... 554/173; 554/191; 554/193

(58) Field of Classification Search ..... 554/173, 554/191, 193
See application file for complete search history.

(56) References Cited

U.S. PATENT DOCUMENTS

| | | | | |
|---|---|---|---|---|
| 4,983,329 | A | 1/1991 | Cooper | |
| 5,387,429 | A | 2/1995 | Cooper | |
| 5,399,729 | A | 3/1995 | Cooper et al. | |
| 5,512,313 | A | 4/1996 | Cooper et al. | |
| 5,571,935 | A * | 11/1996 | Sekula et al. | 554/168 |
| 5,603,978 | A | 2/1997 | White et al. | |
| 5,681,939 | A | 10/1997 | Ferenz | |
| 6,268,010 | B1 | 7/2001 | Sekula | |

FOREIGN PATENT DOCUMENTS

| | | |
|---|---|---|
| WO | WO 98/03461 | 1/1998 |

* cited by examiner

*Primary Examiner* — Deborah D Carr
(74) *Attorney, Agent, or Firm* — RatnerPrestia

(57) ABSTRACT

Highly pure esterified propoxylated glycerin suitable for use as a fat substitute in various foodstuffs may be efficiently manufactured using a process involving direct esterification of propoxylated glycerin with excess fatty acid, bleaching, deacidification/deodorization, and treatment with activated carbon.

16 Claims, 1 Drawing Sheet

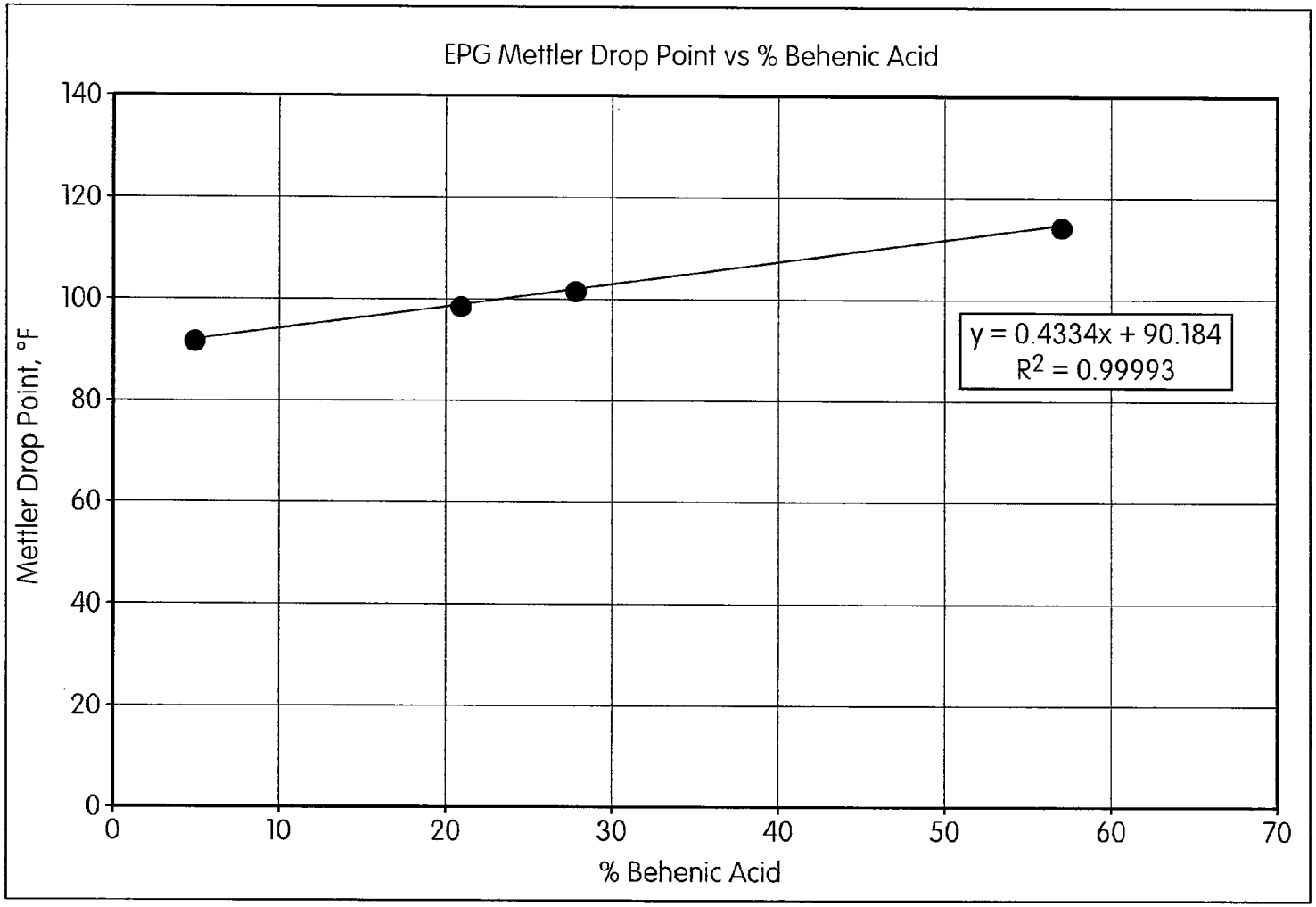
EPG Mettler Drop Point vs % Behenic Acid
y = 0.4334x + 90.184
R2 = 0.99993
Mettler Drop Point, °F
% Behenic Acid
0
20
40
60
80
100
120
140
0
10
20
30
40
50
60
70

PROCESS FOR PRODUCING ESTERIFIED PROPOXYLATED GLYCERIN

FIELD OF THE INVENTION

The invention relates to methods for manufacturing and purifying esterified propoxylated glycerin, which may be utilized as a substitute for triglycerides such as oils and fats in food compositions.

BACKGROUND OF THE RELATED ART

Esterified propoxylated glycerin has long been recognized as a substance potentially useful as a reduced calorie substitute for conventional triglyceride fats and oils in food compositions. However, to be fully acceptable for commercial use as a food ingredient, an esterified propoxylated glycerin must meet a number of significant criteria. For example, the esterified propoxylated glycerin should be clear when in liquid form (e.g., an esterified propoxylated glycerin which is normally solid at room temperature should nonetheless be transparent when melted), low in color, odor, contaminants and free fatty acid content, and bland in taste. At the same time, however, any process employed to produce such an esterified propoxylated glycerin must also be relatively efficient and low in cost for the esterified propoxylated glycerin to be competitive with other fat substitutes on the market. Although a number of different ways of producing esterified propoxylated glycerin have been described in the art, there is still a need for improved, streamlined processes capable of producing high quality, food grade esterified propoxylated glycerin at a low cost.

BRIEF SUMMARY OF THE INVENTION

The present invention provides a method for making a refined esterified propoxylated glycerin fat substitute suitable for use in food compositions. The method comprises (or consists essentially of or consists of), in sequence, the steps of:

a). esterifying a propoxylated glycerin with a stoichiometric excess of one or more fatty acids to provide an initial esterification reaction mixture for a time and at a temperature effective to achieve at least 95% esterification of the propoxylated glycerin;

b). contacting the initial esterification reaction mixture with a bleaching clay for a time and at a temperature effective to reduce the color of the initial esterification reaction mixture;

c). filtering the initial esterification reaction mixture to remove the bleaching clay;

d). subjecting the initial esterification reaction mixture to steam stripping to remove unreacted fatty acid to provide a deacidified and deodorized product;

e). combining the deacidified and deodorized product with activated carbon and an antioxidant and contacting the deacidified and deodorized product with the activated carbon for a time and at a temperature effective to reduce the color of the deacidified and deodorized product; and f). filtering the deacidified and deodorized product to remove the activated carbon.

This process has the advantage of avoiding a hydrogenation step wherein the esterified propoxylated glycerin is hydrogenated. As will be explained in more detail subsequently, a highly saturated esterified propoxylated glycerin can be obtained by means of the inventive process without the need for hydrogenation. Another advantage is that pre-stripping of excess fatty acid prior to bleaching is not necessary. In accordance with the present invention, stripping of unreacted fatty acid and deodorization are carried in a single step.

Since the inventive process is comprised of fewer steps than the processes described in the prior art, it significantly reduces the total time the esterified propoxylated glycerin is exposed to high process temperatures. As a result, high quality esterified propoxylated glycerin which exhibits lighter color and which potentially has a better shelf life/stability may be obtained through practice of this invention. Previously known processes yielded esterified propoxylated glycerin (EPG) exhibiting "fixed" color as a result of temperature degradation, e.g. oxidation and polymerization, which in turn leads to reduced shelf life due to off-flavor development. Additionally, the limited number of steps in the inventive process is also advantageous since overall cycle time may be significantly reduced, leading to more efficient utilization of equipment, lower utility costs, and hence reduced production costs per unit of esterified propoxylated glycerin.

Another advantage of the present process is that the fatty acid recovered by distillation in the new process is also of higher quality than that obtained in the prior art processes because it is derived from an esterified propoxylated glycerin that has already been purified by bleaching. This recovered fatty acid thus may be conveniently recycled back to the esterification step without having to first subject it to costly purification steps.

BRIEF DESCRIPTION OF THE DRAWING

FIG. 1 shows the relationship between the behenic acid (C22:0) content of an esterified propoxylated glycerin containing an average of 5 oxypropylene units per molecule and its melting point, as explained in more detail in the Examples.

DETAILED DESCRIPTION OF CERTAIN EMBODIMENTS OF THE INVENTION

The propoxylated glycerin reactant employed in the process of this invention may be prepared by any of the standard methods known in the art such as, for example, the base-catalyzed reaction of propylene oxide with glycerin. While the molar ratio of propylene oxide to glycerin is not critical, in one embodiment of the invention from 2 to 20 moles of epoxide is reacted per mole of glycerin. In another embodiment, the propoxylated glycerin contains an average of 2 to 5 oxypropylene groups derived from propylene oxide. The propoxylation of glycerin can be carried out by the addition of propylene oxide to glycerin in the presence of a catalytic amount of an alkali metal alkoxylate at a temperature of from about 70° C. to 130° C. The alkali metal alkoxylate is desirably prepared by heating an alkali metal compound such as sodium hydroxide or potassium hydroxide with glycerin at an elevated temperature while continuously removing water, preferably under reduced pressure. In one embodiment, sufficient catalyst is present during propoxylation to provide an alkali metal content of about 0.0003 moles to 3.3 moles alkali metal per 100 g of glycerin. The propylene oxide may be fed incrementally into a reactor containing the glycerin and catalyst at a rate sufficient to maintain a pressure within the reactor of about 40 to 80 psia. The degree of propoxylation is controlled, and thus the molecular weight of the propoxylated glycerin as well, by regulating the amount of propylene oxide fed to the reactor. After the desired molecular weight is reached, the alkali metal may be removed prior to esterification by any suitable method such as absorption, ion exchange, or extraction. Propoxylated glycerin is also commercially available from multiple sources.

The fatty acids which may be employed as reactants in the present invention may be saturated or unsaturated fatty acids or mixtures thereof. Straight chain as well as branched fatty acids may be used. In one embodiment, the fatty acid is a $C_{10}$-$C_{24}$ fatty acid (i.e., an acid which contains from 10 to 24 carbon atoms). Mixtures of different length fatty acids may be used. The fatty acid may be a monocarboxylic acid and/or a polycarboxylic acid (for example, a dimer or trimer fatty acid). An excess of fatty acid, such as from 0.5 to 40% or 1 to 15% or 1 to 10% or 1 to 5% molar excess relative to the amount of propoxylated glycerin, is employed in the present process in order to catalyze the desired esterification such that the desired esterified propoxylated glycerin product may be rapidly obtained without adding other catalysts. Illustrative of the $C_{10}$-$C_{24}$ fatty acids which may be utilized are saturated acids such as capric, lauric, myristic, pentadecanoic, palmitic, heptadecanoic, stearic, nonadecanoic, eicosanoic, and behenic acid. When it is desired to prepare an esterified propoxylated glycerin having a melting point (as measured by Mettler drop point) of 37° C. or higher from a propoxylated glycerin containing approximately five moles of propylene oxide per mole of glycerin, it will be desirable to use a fatty acid source having a relatively high behenic acid (C22:0) content (e.g., at least 20 mole %, at least 25 mole %, at least 30 mole % or at least 50 mole %).

Unsaturated fatty acids which are suitable for use include, but are not limited to, palmitoleic, oleic, linoleic, linolenic, and arachidonic acid. The mixtures of fatty acids which are conveniently available by conventional splitting (hydrolysis) of natural and hydrogenated vegetable oils and animal fats are also appropriate for use such as, for example, soybean oil fatty acids, hydrogenated high erucic rapeseed oil fatty acids, coconut oil fatty acids and the like. An important advantage of the present invention is that a large excess of fatty acid need not be used, since minimal fatty acid will be lost from the reactor. The process may thus be advantageously performed with not more than 5%, or not more than 10%, or not more than 15% molar excess fatty acid.

In one aspect of the invention, the fatty acid or mixture of fatty acids selected for reaction with the propoxylated glycerin is selected to provide the fatty acid content (composition) desired in the final esterified propoxylated glycerin product. The physical properties and other characteristics of esterified propoxylated glycerin compositions may be varied and controlled by adjusting the types of fatty acid ester groups present in the esterified propoxylated glycerin. For example, the solid fat index (SFI) of an esterified propoxylated glycerin may generally be increased by reducing the proportion of unsaturated fatty acid ester groups present in the esterified propoxylated glycerin. Conventionally, this has been achieved by esterifying a propoxylated glycerin with a fatty acid mixture containing unsaturated fatty acids and then hydrogenating the resulting esterified propoxylated glycerin to convert at least a portion of such unsaturated fatty acid ester groups to saturated fatty acid ester groups. In one aspect of the present invention, a hydrogenation step is avoided by utilizing a fatty acid reactant during the esterification step that already possesses the desired final level of unsaturation. Omitting a hydrogenation step of esterified propoxylated glycerin has the advantage of being able to attain a highly saturated product containing essentially no trans fatty acid ester groups. That is, hydrogenating a substance containing cis carbon-carbon double bonds generally leads to the conversion of at least some of those cis carbon-carbon double bonds to trans carbon-carbon double bonds, unless the hydrogenation is continued to completion (0% unsaturation). The present invention thus provides an efficient method for manufacturing esterified propoxylated glycerin having a high degree of saturation and no trans fatty acid ester content.

The addition of distilled, highly concentrated, specific fatty acids is also beneficial when it is necessary to supplement the fatty acid mixture with a specific acid to increase or decrease the melting point of the finished esterified propoxylated glycerin. Stearic and behenic acids increase melting point while unsaturated fatty acid such as oleic or shorter carbon chain saturated acids (e.g., myristic or lauric) decrease the melting temperature of finished esterified propoxylated glycerins.

In one embodiment of the invention, for example, the fatty acids used to esterify the propoxylated glycerin are a mixture of hydrogenated unfractionated fatty acids derived from a high erucic vegetable oil and hydrogenated unfractionated fatty acids derived from at least one additional vegetable oil having a total C16+C18 fatty acid content of at least 90 weight percent (alternatively, at least 95 weight percent). The ratio of high erucic vegetable oil fatty acids to additional vegetable oil fatty acids in the mixture may be varied as may be desired to attain a particular set of properties in the finished esterified propoxylated glycerin. For example, the weight ratio of hydrogenated unfractionated fatty acids derived from a high erucic vegetable oil:hydrogenated unfractionated fatty acids derived from at least one additional vegetable oil having a total C16+C18 fatty acid content of at least 90 weight percent may be in the range of from 99:1 to 75:25. High erucic vegetable oils are triglycerides having a relatively high content (e.g. at least 40 weight %) of erucic acid (a C22 fatty acid) such as high erucic rapeseed oil and crambeseed oil. The additional vegetable oil having a C16+C18 fatty acid content of at least 90 weight percent may, for example, be soybean oil, canola oil, corn oil, cottonseed oil, peanut oil, safflower oil, sunflower oil or the like. In one embodiment, the unfractionated fatty acids are obtained by blending two or more vegetable oils (for example, high erucic rapeseed oil and soybean oil or other oil high in C18 fatty acid content), hydrogenating the blend of oils, and then splitting (hydrolyzing) the hydrogenated, blended oils using conventional splitting methods. The unfractionated fatty acids may alternatively be obtained by first splitting the individual oils (triglycerides), with the fatty acids thereby obtained then being hydrogenated without fractionation, the unfractionated fatty acids then being combined to provide the fatty acid mixture used in the esterification. Another approach which may be used is to split (hydrolyze) the individual oils, combine the resulting fatty acids (after separation from the glycerin), and then hydrogenate the combined fatty acid mixture to the desired level of residual unsaturation. In various embodiments of the invention, the oils or unfractionated fatty acids may be partially or fully hydrogenated to reduce or even essentially eliminate any unsaturation present. For example, hydrogenation may be carried out until the oils or fatty acids have an iodine value (iodine number) of less than 20 or less than 10 or less than 5 or less than 2 centigrams $I_2$ per gram. The aforementioned mixtures of hydrogenated unfractionated fatty acids may be further modified, if so desired, by the addition of minor amounts (e.g., less than 10 weight % or less than 5 weight %) of fractionated fatty acids such as stearic acid, palmitic acid, behenic acid, or the like.

In one step of the process of the present invention, esterification of propoxylated glycerin with a stoichiometric excess of one or more fatty acids to provide an initial esterification reaction mixture is carried out for a time and at a temperature effective to achieve at least 95% esterification of the propoxylated glycerin, thereby providing an initial esterification reaction mixture. The direct esterification methods described in U.S. Pat. No. 5,681,939 (incorporated herein by reference in its entirety for all purposes) may, for example, be adapted for use in the esterification step of the present invention. In such a direct esterification, propoxylated glycerin is esterified with excess fatty acid by a process wherein the temperature is increased incrementally and the pressure is reduced incrementally during the course of esterification while removing the water formed as a by-product. The propoxylated glycerin and the fatty acid may be introduced into a reaction zone to form a reaction mixture. The component reactants may be added separately or, if so desired, first combined or blended prior to entering the reaction zone. The reaction mixture may initially be at a temperature of from about 20° C. to about 80° C. and a pressure of from about 13 to 16 psia. The initial pressure, for example, may conveniently be atmospheric pressure and the initial temperature may be room temperature or, if needed to completely melt the reactants to form a homogeneous liquid phase, somewhat higher than room temperature. While the configuration and design of the reaction zone is not critical, a reactor vessel should be selected which is capable of heating and agitating (mixing) the contents of the vessel under subatmospheric pressure. Means for introducing the reactants and for removing the water of reaction (preferably, as an overhead stream in vapor form) from the vessel should also be provided. It may be advantageous to utilize equipment which will provide high shear mixing (e.g., a 5 to 600 m/min. tip speed, which typically may be achieved by a drive motor energy input of 1.5 to 3 kilowatts per 1000 liters of reaction mixture). Thin film reaction systems may also be employed. In a particularly desirable embodiment of the invention, no materials other than the fatty acid and the propoxylated glycerin are introduced into the reaction zone; i.e., no catalyst, solvent, entrainer, or azeotropic stripping agent is present.

The pressure may thereafter be reduced in an incremental manner within the reaction zone simultaneous with incrementally increasing the temperature of the reaction mixture. In one embodiment of the invention, the pressure is reduced below atmospheric pressure by the time the temperature of the reaction mixture exceeds 80° C. The reaction mixture may be agitated while removing from the reaction zone the water generated by esterification of the propoxylated glycerin by the fatty acid, preferably in vapor form as an overhead stream. Removal of the water has been found to be essential to driving the esterification, which is an equilibrium reaction, to the desired degree of completion. It has been found that esterification may be most rapidly completed if the concentration of water in the reaction mixture is maintained below 5 weight % (more preferably, below 1 weight %) by controlling the rate of water removal. At the same time, the pressure is not lowered and the temperature is not increased at rates such that components of the reaction mixture other than water are removed to any significant extent in vapor or entrained form from the reaction zone. That is, it has been found that if both the temperature and pressure are initially or quickly set to the values which will ultimately be necessary to accomplish complete esterification, the large volume of water which is rapidly evolved causes certain of the more volatile species present in the reaction mixture (such as, for example, unreacted fatty acids, especially shorter chain fatty acids or propoxylated glycerin containing a minimal number of oxypropylene units) to be lost from the reaction zone together with the water. A portion of such losses may be due to the steam stripping effect of the water, while foaming, "bumping", and entrainment phenomena may also contribute to the undesired removal of the reactant components. Put a different way, it is advantageous to keep a sufficiently low pressure and sufficiently high temperature to quickly remove water but not such a low pressure or high temperature that fatty acids and the like are stripped from the reaction vessel.

The rates at which the pressure and temperature are incrementally adjusted are preferably selected such that the desired level of esterification of the propoxylated glycerin is obtained within a practically short period of time (e.g., 12 hours or less) while minimizing losses of organic substances from the reaction zone. The rates at which pressure and temperature are varied may be constant or may, if so desired, be increased or decreased periodically. In one embodiment of the invention, for example, the rate of temperature increase is fairly high during the first 1-2 hours of the reaction while the rate of pressure decrease is relatively low during such period. The present invention is capable of being operated such that less than 5% (preferably, less than 1%) of the fatty acid which is initially charged to the reaction zone is lost during the course of esterification. In one embodiment, the molar ratio of water to fatty acid being removed from the reaction zone is at least 10:1. The optimum reaction parameters will vary somewhat depending upon such factors as the amount of excess fatty acid and the relative reactivities and volatilities of the fatty acid and propoxylated glycerin reactants, but may be readily determined by routine experimentation.

The esterification step of the process may be performed in a batch, continuous, or semi-continuous manner. When operated in a batch mode, for example, the initial reactants may be simply combined in a single vessel and then subjected to the temperature and pressure regimen described hereinabove such that the entire contents of the vessel are exposed simultaneously to the same reaction conditions. In a continuous process, the fatty acid and propoxylated glycerin may be introduced at one end of a reactor under the initial temperature and pressure conditions set forth above and then carried forward through the reactor in a series of stages or the like wherein the temperature is incrementally increased and the pressure is incrementally lowered in each successive stage, with the esterified propoxylated glycerin product being withdrawn from the other end of the reactor. Means are provided within each stage for withdrawing water vapor from the reaction mixture. A multiple stage continuous stirred tank reactor battery or cascade comprising two or more separate reactors or a multiple stage continuous stirred tank in a single shell may be utilized, for example.

The temperature of the reaction mixture is gradually increased through the course of the process until a final temperature not exceeding 275° C. is attained. In a preferred embodiment, the final temperature does not exceed 260° C. since some degradation of the reactants and/or esterified propoxylated glycerin may take place at higher temperatures. The final temperature may be at least 120° C. higher (in another embodiment, at least 150° C. higher) than the initial temperature. A final pressure of 4 psia or less (i.e., 0-4 psia) has been found to be helpful to drive the esterification reaction to a desirably high level of completion in a practically short period of time. Generally, it will be advantageous to esterify at least 95% (in another embodiment, at least 97%) of the available hydroxyl groups of the propoxylated glycerin. To rapidly attain such a high level of esterification, it will also be advantageous for the final temperature to be at least 200° C. The reaction mixture can be maintained at the final temperature and pressure for such time as may be needed to achieve the desired degree of esterification; depending upon the final temperature and pressure selected, this time may vary from as little as 1 minute to as long as 4 to 6 hours or longer. The total time required for esterification, as measured from the time variation of the pressure and temperature is initiated, will typically be from 4 to 15 hours.

When a long chain (≧C20), saturated, high melting point fatty acid such as behenic acid is used together with shorter chain and/or unsaturated fatty acids, it may be advantageous to first esterify the propoxylated glycerin with the amount of this long chain, saturated acid desired in the finished product without any excess. Once about 90-95% of the long chain, saturated acid has been reacted with the propoxylated glycerin, the reaction mixture is cooled to 100-120° C., the vacuum is broken with nitrogen and the remaining fatty acid mixture (in an amount effective to provide an overall stoichiometric excess) is added. The second phase of the esterification step is accomplished through the gradual increase of reaction temperature while simultaneously reducing the pressure to remove water, a reaction by-product, following standard process parameters. The advantages of this sequential esterification procedure include:

All long chain, saturated fatty acid (e.g., behenic acid) is esterified with propoxylated glycerin. Thus, no excess must be distilled during the deacidification/deodorization step, minimizing the risk of solidification of this high-melting point material in the vacuum system and transfer lines.

Excessive stripping/deodorization temperatures to distill excess long chain, saturated fatty acid are avoided, preventing losses due to hydrolysis of fatty acids and thermal degradation of esterified propoxylated glycerin.

Thus, esterification may be carried out in at least two phases comprising a first phase wherein the propoxylated glycerin is esterified with a first fatty acid component comprised of behenic acid, the first fatty acid component being present in a less than stoichiometric amount relative to propoxylated glycerin to provide a partially esterified propoxylated glycerin, and a second phase wherein the partially esterified propoxylated glycerin is esterified with a second fatty acid component which does not contain a significant amount of behenic acid (e.g., less than 0.5 weight %), the second fatty acid component being present in an amount effective to provide an overall stoichiometric excess amount of fatty acid.

Once the desired degree of esterification has been accomplished, the initial esterification reaction mixture is contacted with a bleaching clay for a time and at a temperature effective to reduce the color of the initial esterification reaction mixture. The bleaching step not only improves color but also removes trace metals (detrimental to esterified propoxylated glycerin stability), propylene oxide, potassium and allyl alcohol that in trace levels may carry over from propoxylation of glycerol. The bleaching clay employed may be any of the bleaching clays known in the art to be suitable for use in the processing of conventional oils and fats. Bleaching clays may also be referred to as bleaching earths or bleaching adsorbents and may be based on various types of clays such as hormite, smectite, attapulgite, montmorillonite or mixtures thereof. Different classes of bleaching clays may be utilized in the bleaching step of the present invention, including, without limitation, the class of highly-active, mostly montmorillonite-based bleaching earths (also referred to in the art as High Performance Bleaching Earths, such as acid-activated montmorillonites), the class of naturally active clays (also known in the art as Natural Active Bleaching Earths) such as Fuller's earths, as well as the class referred to as surface activated systems or Surface Modified Bleaching Earths (which are typically prepared by subjecting a naturally active crude clay such as an attapulgite- and hormite-containing crude clay to a small quantity of acid. The bleaching clay may be in particulate or finely divided form and may have a relatively high surface area.

The quantity of bleaching earth employed will vary depending upon the activity of the particular bleaching clay selected as well as the amount of colored impurities in the initial reaction mixture to be bleached, among other factors. Typically, however, from about 0.5 to about 5% by weight bleaching clay, based on the weight of the reaction mixture, is used. The bleaching conditions will also be dependent upon the particular bleaching clay selected and the amount of bleaching clay, among other factors, but generally it will be advantageous to contact the bleaching clay with the reaction mixture at an elevated temperature (e.g., from about 80 to about 125° C.) while the reaction mixture is being maintained under a vacuum (e.g., a pressure of from about 10 to about 100 torr). Contact times of from about 10 minutes to about 2 hours will generally be suitable. The bleaching step is advantageously carried out in the absence of molecular oxygen; for this reason, air should be rigorously excluded while the esterified propoxylated glycerin is being contacted with the bleaching clay.

Once bleaching is completed, the initial esterification reaction mixture is then filtered to remove the bleaching clay. A filter aid such as diatomaceous earth may be added to the mixture to facilitate filtration.

In one embodiment of the invention, the initial esterification reaction mixture is passed through a bed of bleaching clay. The bed may be maintained at a suitable elevated temperature to promote color removal and/or to reduce the viscosity of the initial esterification reaction mixture. Multiple passes through the bed may be carried out in order to achieve the desired level of color reduction. In this embodiment of the invention, the bleaching earth contacting step and filtration step may be considered to be taking place concurrently.

Following removal of the bleaching earth by filtration, the initial esterification reaction mixture is subjected to steam stripping to remove unreacted fatty acid to provide a deacidified and deodorized product. Such steam stripping may be conducted by maintaining the esterified propoxylated glycerin at a temperature above the boiling point of water (for example, at a temperature of from about 150 to about 300° C. or from about 175 to about 275° C. or from about 225 to about 275° C.) and introducing water into the esterified propoxylated glycerin. In one embodiment, steam is slowly bled beneath the surface of the liquefied esterified propoxylated glycerin. The rate of water introduction may be, for example from about 1 to about 10% or from about 2 to about 6% sparging steam per hour. The steam stripping may be carried out in a continuous deodorizer. Generally speaking, it will be advantageous to conduct the steam stripping under vacuum, for example at about 0.5 to about 10 torr absolute pressure. Steam stripping is conducted for a time effective to reduce the free fatty acid content of the esterified propoxylated glycerin to the desired level, e.g., <0.5% or <0.3% or <0.1% by weight free fatty acid. In one embodiment of the invention, the esterified propoxylated glycerin is combined with one or more stabilizers or antioxidants such as a tocopherol or citric acid prior to commencing the steam stripping step.

The excess unreacted fatty acid separated from the esterified propoxylated glycerin in the steam stripping step may be advantageously recycled for use in the esterification step. The recovered fatty acid is remarkably high in purity and thus typically requires little or no treatment prior to such reuse, other than separation from the water also recovered as part of the distillate.

The deacidified and deodorized product is combined with activated carbon and an antioxidant and contacting the deacidified product with the activated carbon for a time and at a temperature effective to reduce the color of the deacidified product. Such carbon treatment may also assist in reducing any remaining off-flavors or off-odors in the esterified propoxylated glycerin. The carbon may be any form of activated carbon available, and may for example be derived from wood, bituminous coal, lignite coal, coconut, bone char, or any other source. Typically, the carbon is in the form of granules, but other physical forms such as powders or bead activated carbon may also be employed. It will generally be advantageous to utilize an activated carbon which is highly porous and which has a high surface area (e.g., over 100 $m^2/g$, over 200 $m^2/g$, or over 300 $m^2/g$). The amount of activated carbon is selected to be sufficient to reduce the color of the esterified propoxylated glycerin and/or improve the flavor and/or odor of the esterified propoxylated glycerin to the desired extent. Typically, from about 0.005 to about 1% by weight activated carbon, relative to the weight of the esterified propoxylated glycerin, is suitable.

Any of the antioxidants conventionally used in fats and oils may be employed in the process of the present invention. If the esterified propoxylated flycerin is to be used as an ingredient in the preparation of a foodstuff, it will be beneficial to utilize an antioxidant approved for such end use. The preferred antioxidants are so-called "natural" antioxidants, but synthetic antioxidants, such as butylated hydroxytoluene (BHT), butylated hydroxyanisole (BHA), tertiary-butylhydroquinone (TBHQ) or propyl gallates, may also be employed. Natural antioxidants include tocopherols, various cereal and seed extracts, such as extracts from sesame and oats, phospholipids, organic acids, and proteins. However, the most widely known and most likely used in crude or refined vegetable oils are tocopherols. The tocopherols most commonly used are actually mixtures of four tocopherols: alpha; beta; gamma; and delta. It has been customary in recent years to supplement natural antioxidants with the synthetic antioxidants, reducing or chelating agents, such as L-ascorbyl palmitate, erythorbic acid, or citric acid, with some indications of synergistic effects from the combination. In the present invention, it is acceptable to use either the natural antioxidants, particularly tocopherols, alone or in combination with synthetic antioxidants or the reducing or chelating agents. It is, of course, also acceptable to use synthetic antioxidants alone, i.e. not combined with any natural antioxidants. The amount of antioxidant in the final esterified propoxylated glycerin may be, for example, from about 0.05 to about 1% by weight based on the weight of the esterified propoxylated glycerin.

In general, the temperature of the esterified propoxylated glycerin may be somewhat elevated while it is being contacted with the activated carbon; for example, the contact temperature may be from about 40 to about 100° C. The esterified propoxylated glycerin/activated carbon mixture may be stirred or otherwise agitated during the contacting step, with the mixture being maintained under an inert atmosphere (e.g., under an $N_2$ atmosphere). In one embodiment of the invention, the deacidified and deodorized esterified propoxylated glycerin is passed through a bed of activated carbon one or more times until the desired level of purity is achieved.

The carbon-treated product is filtered to remove the activated carbon to provide an esterified propoxylated glycerin having organoleptic properties suitable to permit the esterified propoxylated glycerin to be used as a fat substitute in food compositions. Such filtration may be facilitated by adding a filter aid such as diatomaceous earth to the esterified propoxylated glycerin/activated carbon mixture prior to filtration. If the esterified propoxylated glycerin is solid or highly viscous at room temperature, it will be advantageous to conduct the filtration at a somewhat elevated temperature (e.g., about 40 to about 100° C.). Filtration may be repeated if residual particles are still present in the esterified propoxylated glycerin after the first filtration.

In one embodiment, all steps of the process of the present invention are conducted without the use of any organic solvent. That is, the reactants used are free of organic solvent and the esterified propoxylated glycerin is not combined at any point in the process with an organic solvent.

EXAMPLES

Example 1

The process of the present invention may, for example, be carried out as follows. The esterification of propoxylated glycerol (e.g., glycerin which has been reacted with 5 moles of propylene oxide per mole of glycerin) with fatty acids is performed in a 560 L reactor equipped with paratherm heating coils, water cooling coils, an agitator and connected to a vacuum source. The direct esterification reaction (no catalyst is added) is controlled by a gradual increase of temperature (from 70 to 245° C.) during a 7 hour period with simultaneous vacuum increase (from atmospheric to about 10 torr) to remove water (a reaction by-product). Under these parameters about 80-86% esterification is expected during the first 4 hours, while the additional conversion (to 97%) is achieved by extending the reaction time to about 8 hours. The excess of fatty acids used vs. the stoichiometric amount is about 15%, but alternatively could be less (e.g., 5% excess or 10% excess). The fatty acids employed may, for example, be a mixture of distilled food grade stearic acid (90% min. C18:0) and food grade soybean oil distilled fatty acids (weight ratio of stearic acid:soybean oil fatty acids ca. 12.5:1).

Bleaching of the crude esterified propoxylated glycerin obtained above (containing about 10% free fatty acid) is performed in a standard batch bleacher at 100-105° C. with 2% activated bleaching clay and 0.2% filter aid (e.g., diatomaceous earth) under vacuum of 50 torr for about 30 min. Then, the mixture is cooled to 70° C., filtered and mixed with 0.10% tocopherols and 0.1% citric acid solution (20% aqueous solution).

Steam refining and deodorization of the bleached esterified propoxylated glycerin is performed in a continuous deodorizer at 250° C. and a throughput rate of 150 kg/hr using 4% sparging steam/h, under 1-4 torr absolute pressure (vacuum). The stripped/deodorized esterified propoxylated glycerin is cooled to about 70° C., saturated with nitrogen on exit from the deodorizer and transferred to a clean stainless steel container or tank equipped with an agitator for polishing treatment.

Polishing and antioxidant addition is the final process step improving the color of deodorized esterified propoxylated glycerin, removing any impurities which may cause hazy (not brilliant) appearance in a melted state, and stabilizing the product against oxidation. The deodorized esterified propoxylated glycerin is treated with 0.2% activated carbon and 0.1% filter aid at 70° C., mixed for 15 min under nitrogen headspace, then 0.10% Covi-ox® tocopherols are added and mixing continued for additional 15 minutes. Afterwards, the esterified propoxylated glycerin is filtered. A second pass through the filter may be necessary if carbon particles remain in the product after first filtration. Clear and brilliant esterified propoxylated glycerin is poured into clean 1-gallon jars and 5-gallon pails and sealed under $N_2$ headspace.

Example 2

Where it is desired to prepare an esterified propoxylated glycerin containing an average of 5 oxypropylene groups per molecule and exhibiting a relatively high melting point in the 37 to 45° C. (98.6 to 113° F.) range, it is generally necessary to have such a product contain a high (e.g., 21 to 50 weight %) amount of a long chain saturated fatty acid such as behenic acid in the finished product with substantially all of the remaining fatty acids being stearic and palmitic. In such a case, it may be advantageous to conduct a sequential, 2-step esterification process, particularly if there are equipment limitations relative to distilling excess behenic acid after the reaction.

In the first step, propoxylated glycerin is reacted with the required amount of behenic acid for the finished product, under the vacuum and the temperature gradients described in Example 1. Once 90-95% of the behenic acid is esterified, the reaction mixture is cooled to 100-120° C., the vacuum broken with nitrogen and the remaining fatty acid mixture with a stoichiometric excess (predominantly stearic acid and palmitic acid) is added. The esterification reaction is resumed by gradually increasing temperature and reducing pressure in accordance with the procedure described in Example 1. In this example, all behenic acid is reacted with propoxylated glycerin and only the excess fatty acids added in the second step must be distilled off during the deacidification/deodorization process. Bleaching, steam refining/deodorization and polishing of the esterified propoxylated glycerin obtained follow the procedures described in Example 1.

Example 3

To demonstrate the effect of fatty acid composition on the melting point of esterified propoxylated glycerin, a series of esterified propoxylated glycerins was prepared as shown in Table 1. In each case, the propoxylated glycerin used as a starting material contained approximately five moles of propylene oxide per mole of glycerin (propoxylated glycerin molecular weight=393.2, hydroxyl #=428). A 15% molar excess of fatty acid relative to propoxylated glycerin was used to prepare each batch. A linear correlation between the behenic acid content of the esterified propoxylated glycerin and Mettler drop point was observed (FIG. 1).

TABLE 1

| | Example 3-1 | Example 3-2 | Example 3-3 | Example 3-4 |
|---|---|---|---|---|
| Propoxylated glycerin, g | 570.2 | 562.8 | 558.1 | 530.6 |
| Stearic acid, 98.8%, g | 1229.6 | 967.8 | 851.6 | 468.8 |
| Palmitic acid, 98%, g | — | 136.6 | 137.3 | — |
| Behenic acid, 90%, g | 78.6 | 333.6 | 456.9 | 922.9 |
| Liquid soybean oil fatty acids, g | 121.5 | — | — | 73.2 |
| Total fatty acids, g | 1429.7 | 1438 | 1445.8 | 1464.9 |
| Total batch weight, g | 1999.9 | 2000.8 | 2003.8 | 1995.5 |
| Fatty acid composition, wt. % | | | | |
| Palmitic, C16:0 | 1.9 | 10.2 | 10.1 | 0.9 |
| Stearic, C18:0 | 85.7 | 68.1 | 59.1 | 36.2 |
| Oleic, C18:1 | 1.9 | — | — | 1.1 |
| Linoleic, C18:2 | 4.7 | — | — | 2.8 |
| Linolenic, C18:3 | 0.4 | — | 0.2 | |
| Arachidic, C20:0 | 0.1 | — | 2.2 | 0.1 |
| Behenic, C22:0 | 5.0 | 21.1 | 28.1 | 57.2 |
| Other | 0.3 | 0.6 | 0.5 | 1.5 |
| Mettler Drop Pt, ° F. | 92.2 | 99.2 | 102.5 | 115 |
| Mettler Drop Pt, ° C. | 33.5 | 37.3 | 39.2 | 46.1 |

What is claimed is:

1. A method for making a refined esterified propoxylated glycerin fat substitute, wherein the method comprises, in sequence, the steps of:

a). esterifying a propoxylated glycerin with a stoichiometric excess of one or more fatty acids to provide an initial esterification reaction mixture for a time and at a temperature effective to achieve at least 95% esterification of the propoxylated glycerin;

b). contacting the initial esterification reaction mixture with a bleaching clay for a time and at a temperature effective to reduce the color of the initial esterification reaction mixture;

c). filtering the initial esterification reaction mixture to remove the bleaching clay;

d). subjecting the initial esterification reaction mixture to steam stripping to remove unreacted fatty acid to provide a deacidified and deodorized product;

e). combining the deacidified and deodorized product with activated carbon and an antioxidant and contacting the deacidified and deodorized product with the activated carbon for a time and at a temperature effective to reduce the color of the deacidified and deodorized product; and f). filtering the deacidified and deodorized product to remove the activated carbon.

2. The method of claim 1, wherein the method consists essentially of steps a)-f).

3. The method of claim 1, wherein the method consists of steps a)-f).

4. The method of claim 1, wherein the deacidified and deodorized product is not subjected to hydrogenation.

5. The method of claim 1, wherein at least 80 weight % of the fatty acids used to esterify the propoxylated glycerin are saturated fatty acids.

6. The method of claim 1, wherein step a) is carried out in the absence of any added catalyst.

7. The method of claim 1, wherein step b) is carried out under vacuum.

8. The method of claim 1, wherein step b) is carried out at a temperature of from 80° to 120° C. for a time of from 10 to 60 minutes.

9. The method of claim 1, wherein the antioxidant is a tocopherol or mixture of tocopherols.

10. The method of claim 1, wherein the refined esterified propoxylated glycerin is solid at 25° C.

11. The method of claim 1, wherein the deacidified and deodorized product is solid at 25° C. and the filtration in step f) is carried out in the absence of solvent at a temperature effective to liquefy the deacidified and deodorized product.

12. The method of claim 1, wherein the stoichiometric excess of fatty acid in step a) is from 1 to 15%.

13. The method of claim 1, wherein step a) is carried out by a process wherein temperature is increased incrementally and pressure is reduced incrementally while removing water formed as a by-product of esterification.

14. The method of claim 1, wherein excess unreacted fatty acid recovered by steam stripping in step d) is recycled to esterification step a).

15. The method of claim 1, wherein the fatty acids used to esterify the propoxylated glycerin are a mixture of hydrogenated unfractionated fatty acids derived from high erucic rapeseed oil and hydrogenated unfractionated fatty acids derived from at least one vegetable oil having a total C16+C18 fatty acid content of at least 90 weight percent.

16. The method of claim 1, wherein step a) is carried out in at least two phases comprising a first phase wherein the propoxylated glycerin is esterified with a first fatty acid component comprised of behenic acid, the first fatty acid component being present in a less than stoichiometric amount relative to propoxylated glycerin to provide a partially esterified propoxylated glycerin, and a second phase wherein the partially esterified propoxylated glycerin is esterified with a second fatty acid component which does not contain a significant amount of behenic acid, the second fatty acid component being present in an amount effective to provide an overall stoichiometric excess amount of fatty acid.

* * * * *